US007354041B2

(12) United States Patent
McKee et al.

(10) Patent No.: US 7,354,041 B2
(45) Date of Patent: Apr. 8, 2008

(54) CARD GAME SUITABLE FOR CASINO PLAY

(75) Inventors: Ricky D. McKee, Everman, TX (US); Brooke Stephens, Plano, TX (US)

(73) Assignee: Worldwide Gaming, Inc., Forney, TX (US)

( * ) Notice: Subject to any disclaimer, the term of this patent is extended or adjusted under 35 U.S.C. 154(b) by 295 days.

(21) Appl. No.: 10/835,104

(22) Filed: Apr. 29, 2004

(65) Prior Publication Data

US 2005/0242504 A1 Nov. 3, 2005

(51) Int. Cl.
*A63F 1/00* (2006.01)

(52) U.S. Cl. ..... 273/292; 273/274; 463/13

(58) Field of Classification Search ..... 273/292, 273/274, 309; 463/12, 13
See application file for complete search history.

(56) References Cited

U.S. PATENT DOCUMENTS 3,998,462 A * 12/1976 Goott ..... 273/274
4,836,553 A 6/1989 Suttle et al.
5,288,081 A 2/1994 Breeding
5,775,992 A * 7/1998 Wood et al. ..... 463/13
5,947,821 A * 9/1999 Stone ..... 463/13
6,390,474 B1 5/2002 Terminel et al.
6,719,292 B2 4/2004 Lo
2003/0134670 A1* 7/2003 Kilby ..... 463/13
2003/0153380 A1* 8/2003 Dreaper et al. ..... 463/16

* cited by examiner

*Primary Examiner*—Benjamin Layno
(74) *Attorney, Agent, or Firm*—Slater & Matsil, L.L.P.

(57) ABSTRACT

System and method for playing a card game is provided. An embodiment for play in a casino using a standard deck of cards comprises allowing a player to place a wager on a selected card value, a wild card value, black, red, or lo ball. Community cards are dealt face up and winning hands are paid according to a predetermined payout schedule. Wagers on a selected card values and wild card values have predetermined payout values for specific winning hands. Black and red wagers have predetermined payout values if all of the community cards are black or red, respectively. Lo ball wagers have a predetermined payout value if all of the community cards are less than or equal to a predetermined value, such as 8. In another embodiment, the card game may be implemented in a computer system having a video display terminal.

24 Claims, 2 Drawing Sheets

CARD GAME SUITABLE FOR CASINO PLAY

TECHNICAL FIELD

The present invention relates generally to a system and method for playing games of pleasure, and more particularly to a system and method for a table or video card game.

BACKGROUND

Generally, casinos provide a variety of games for gamblers to wager. The more popular games include Blackjack, Pai Gow Poker, Poker and its variations, Keno, Baccarat, Roulet, and Craps. Despite the familiarity of these games, gamblers, particularly the regulars, frequently tire of playing the same old games. As a result, gamblers may tend to become disinterested or gamble less.

Accordingly, casinos are frequently looking for new games to offer to its clientele. New games should be easy to understand, interesting, and allow for a high rate of card play for both regular gamblers and the average person on vacation. One particular concern for casinos is that the average person on vacation may or may not have a familiarity with many of the wagering games. This average person is likely to be unwilling to sit down for an extended period of time to learn a new game. Rather, the average person is more interested in the social interaction that comes with casino gambling and the possibility of winning.

Examples of new games that have been introduced in the past include Caribbean Stud™, which is described in U.S. Pat. No. 4,836,553, issued to Suttle, et al., and Let It Ride™, which is described in U.S. Pat. No. 5,288,081, issued to Breeding. These games have had considerable success and are characterized by simple to understand rules and a fast rate of play. The games also allow the gamblers to interact within a social environment.

Accordingly, an object of the present invention is to provide a system and method for providing a card game suitable for casino play in multiple formats, such as at a table, a video terminal, or the like.

SUMMARY OF THE INVENTION

These and other problems are generally solved or circumvented, and technical advantages are generally achieved, by preferred embodiments of the present invention which provides a system and method for a table or video card game.

In accordance with a preferred embodiment of the present invention, a method for providing a card game comprising providing a mechanism for a player to place a wager on one of a selected card value, a wild card value, a first color, a second color, and lo ball. Community cards are provided and a determination is made whether or not the player has a winning hand, wherein a wager on a selected card value wins if the selected card value may be used with the community cards to make a first winning hand, the first winning hand comprising at least one of one pair, two pair, three of a kind, flush, straight, full house, four of a kind, straight flush, and five of a kind, wherein a wager on a wild card value wins if any card may be used to make a second winning hand, the second winning hand comprising at least one of three of a kind, flush, straight, full house, four of a kind, straight flush, and five of a kind, wherein a wager on the first color wins if all of the community cards are the first color, wherein a wager on second color wins if all of the community cards are the second color, and wherein a wager on lo ball wins if all of the community cards are equal to or less than a first value.

In accordance with another embodiment, a computer system and a video terminal is provided that allows a player to play a virtual card game via the video terminal.

It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a casino card game. The invention may also be applied, however, to other individual or group video games on video poker-style machines, PDAs, mobile units, laptop computers, desktop computers, or the like.

Figure 1:
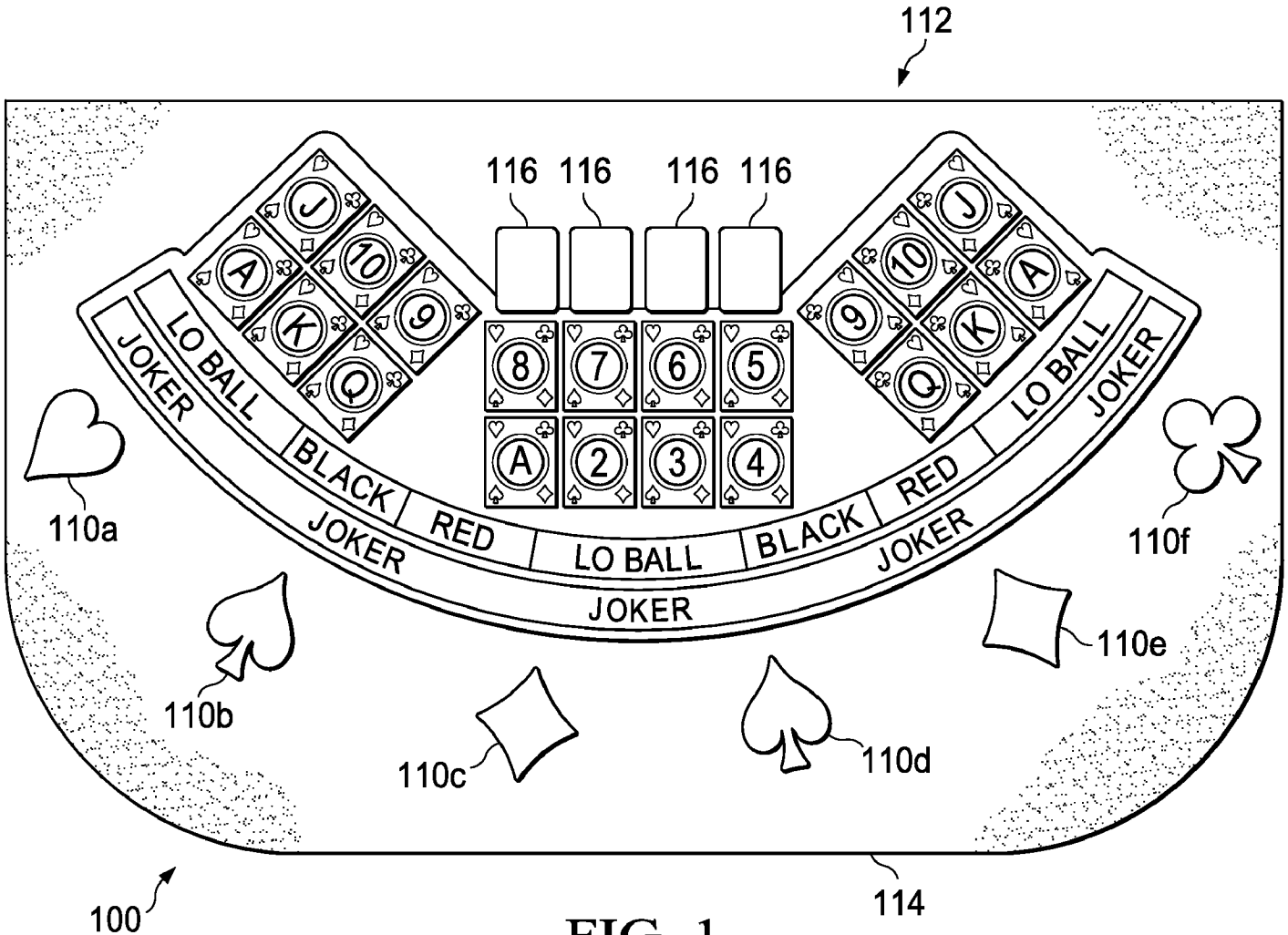
FIG. 1 is a table layout that may be used to play a card game in accordance with an embodiment of the present invention.

With reference now to FIG. 1, there is shown a table layout 100 that may be used in an embodiment of the present invention. It should be noted that the table layout illustrated in FIG. 1 is provided for illustrative purposes only, and that embodiments of the present invention may be utilized with many different table designs and layouts. The table layout 100 comprises six player emblems 110*a-f* and a dealer location 112 positioned at approximately opposing sides of a table 114. The table layout 100 identifies each player location by one of the symbols commonly used to identify a suit of card, i.e., heart, diamond, club, and spade. Other symbols or identifiers, such as shapes, numbers, figures, or the like, may be used.

The table layout 100 includes locations to place single-card bets (identified by the numbers 2-10, Jack, Queen, King, and Ace), a Joker bet, a Lo Ball bet, a Red bet, and a Black bet. The table layout 100 further includes locations for four community cards 116. The use of the community cards 116 and the bets will be discussed below.

Figure 2:
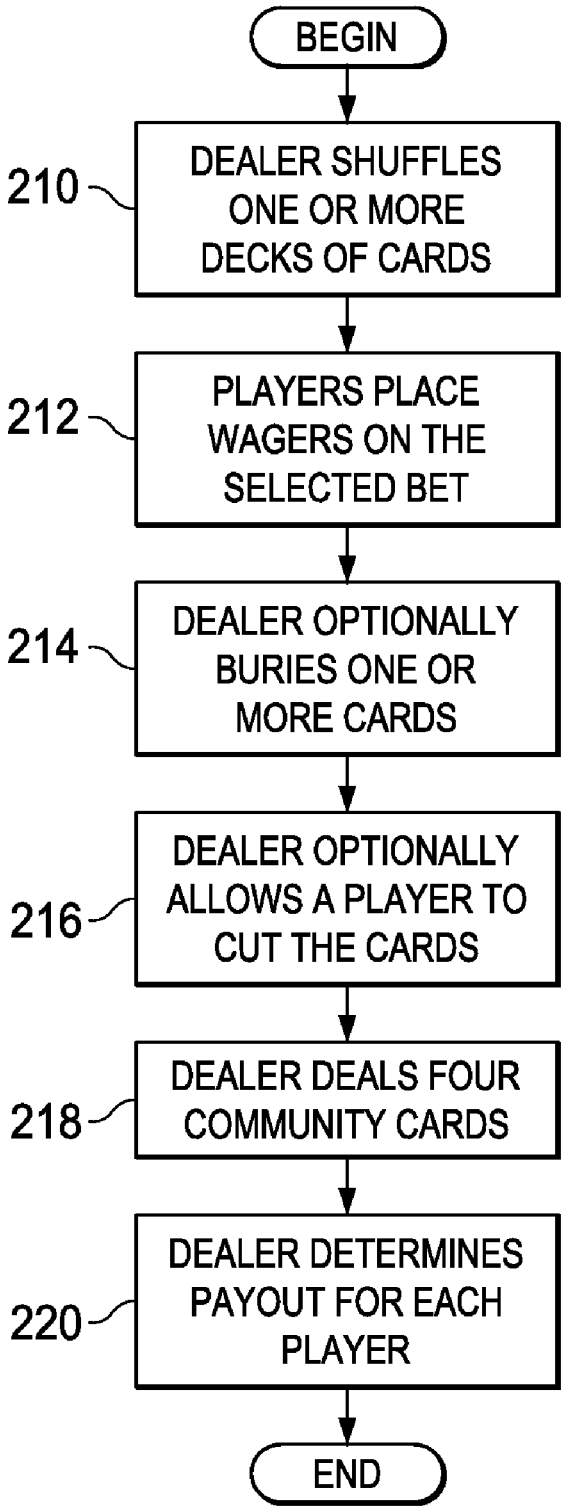
FIG. 2 is a data flow diagram illustrating the process used to play a card game in accordance with an embodiment of the present invention.

FIG. 2 is a data flow diagram illustrating a flow of a card game in accordance with an embodiment of the present invention. The game begins in step 210, wherein a dealer shuffles one or more decks of cards. In one embodiment, the deck of cards are shuffled after each hand. Therefore, because each hand utilizes 4 cards (i.e., 4 community cards) it is not necessary to utilize more than one deck of cards. In other embodiments, however, the deck may not be shuffled after every hand and one or more decks may be desired. The deck in this embodiment is similar to a multi-deck used in some Blackjack games.

In step 212, the dealer verifies that the players have placed the desired wagers. It should be noted that wagers may be placed, or changed, at any time while the deck is being shuffled up to the point at which the dealer is prepared to deal the community cards. The players make wagers by placing money or tokens on the tables at the location indicating the wager the player wishes to make.

Steps 214 and 216 represent two optional steps. The first step, step 214, represents that the dealer may optionally bury one or more cards by taking one or more cards from the top of the deck and placing them on the bottom of the deck or in the deck. The second step, step 216, represents that the dealer may cut the deck or allow someone else (e.g., a player) to cut the deck. The deck may be cut by removing a portion of the deck for the dealer to place on the bottom, or by placing a colored card or other indicator into the deck to indicate to the dealer where the deck is to be cut.

Next, in step 218, the dealer removes community cards from the top of the deck and places the community cards face up on the table at the locations for the community cards, such as location 116. It should be noted that in an embodiment, four community cards are dealt. In this manner, the four cards may be combined with a card value wagered by the player to form a five card poker hand, which is generally familiar to players.

Finally, in step 220 the dealer determines the payout, if any, due to each player. The payout is determined by the amount the player wagered and the bet the player made.

Thereafter, the process may be repeated to play another hand. As discussed above, the deck of cards may be reshuffled or a plurality of hands may be played from one or more decks between shuffles.

A single-card bet allows the player making the wager to select a card to be combined with the community cards. The payout is based on a poker hand formed by the combination of cards, with the exception that one pair must use the card selected by the player. In other words, one pair made only with the community cards does not pay, i.e., the player loses the wager.

In an embodiment, the player makes a single-card wager by placing money or tokens on one of the symbols representing the single cards of the deck, i.e., 2-10, J, Q, K, and A. The symbols representing the single cards of the deck may include a symbol or other identifier that represents the player making the wager. For example, in the embodiment illustrated in FIG. 1, each symbol representing a card has a symbol representing one of the four suits in each corner. The suits correspond to the emblems used to identify the player emblems 110*a-f*. Thus, a player sitting at the player location identified by a spade emblem wanting to place a wager on a "10" card would place a wager on the spade emblem associated with the "10" card. The use of a player emblem aids the dealer in determining which player made each bet.

The following table illustrates payouts for a single-card wager that may be used in an embodiment of the present invention. Other payouts may be used.

| Hand Type | Pay to 1 |
|---|---|
| Five of a Kind | 250 |
| Straight Flush | 125 |

-continued

| Hand Type | Pay to 1 |
|---|---|
| Four of a Kind | 50 |
| Full House | 20 |
| Straight | 15 |
| Flush | 7 |
| Three of a Kind | 3 |
| Two Pair | 2 |
| One Pair | 1 |

The Joker bet is similar to the single-card bet, except that the player can chose any card and any suit to play with the community cards after the community cards are displayed. It should be appreciated that the player will automatically have a pair. Accordingly, because the odds are different when selecting a Joker, the payouts will usually be different. The following table illustrates payouts for a joker bet that may be used in an embodiment of the present invention.

| Hand Type | Pay to 1 |
|---|---|
| Five of a Kind | 50 |
| Straight Flush | 30 |
| Four of a Kind | 6 |
| Full House | 6 |
| Straight | 2 |
| Flush | 6 |
| Three of a Kind | 1 |
| Two Pair | Lose |
| One Pair | Lose |

The Lo Ball bet comprises wagering that all of the community cards will be below some predetermined value. In one embodiment, the Lo Ball bet is a wager that all of the community cards will be an "8" or lower, wherein the Ace is considered a one, i.e., each of the community cards is an Ace, 1, 2, 3, 4, 5, 6, 7, or 8. It should be noted that the Lo Ball wager only utilizes the community cards and that the player does not need to select a fifth card. It should also be noted that pairs, three of a kind, four of a kind, flushes, or straights do not cause the player to lose his Lo Ball wager. Thus, if the four community cards were (5-spade, 5-heart, 5-spade, 5-club), making a four of a kind of four fives, the player making a Lo Ball wager still wins because all of the community cards are an 8 or lower. In one embodiment, the payout of a Lo Ball bet using four community cards is 6-to-1.

In another embodiment, however, a Lo Ball wager may used to indicate a low-hand type of a wager in which the community cards must be below a predetermined value and no pairs, straights, or flushes may be made. In this embodiment, the player may push or lose the bet if a pair, straight, or flush is made with the community cards.

A Black or Red bet is simply a bet that all of the community cards will be either black or red, respectively. In one embodiment, the Black or Red bet is irregardless of whether or not the community card includes pairs, straights, or flushes. For example, if the community cards contain include (3-spade, 3-club, 5-spade, Q-club), then a player placing a wager on the Black bet wins because all of the community cards are black. In this embodiment, a payout that may be used is 16-to-1.

Similar to the Lo Ball bet, another embodiment of the present invention may cause a player to lose a wager made on the Black or Red bet if the community cards contains a pair, a straight, and/or a flush. Thus, in the example described above, the player would lose the wager because the community cards include a pair (3-spade, 3-club).

It should be appreciated that embodiments of the present invention may be easily implemented in video poker style machines. For example, one embodiment may allow a player to sit at a computer system having a video display terminal and insert money, tokens, chips, game card, or the like. The player may then select the type of bet that the player wishes to make and cause the computer system to randomly generate the community cards. The computer system may then automatically calculate the payout and pay or credit the player the appropriate amount.

Although the present invention and its advantages have been described in detail, it should be understood that various changes, substitutions and alterations can be made herein without departing from the spirit and scope of the invention as defined by the appended claims. For example, payout schedules, table layouts, bets, and the like may be altered to offer players variations of embodiments of the present invention while remaining within the scope of the present invention.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for playing a card game, the method comprising:

providing a deck of cards having a plurality of colors and a plurality of values;

receiving a wager on one or more of a selected card value, a wild card value, a first color, a second color, and lo ball, each of the selected card value, the wild card value, the first color, the second color, and lo ball being offered, a card corresponding to the selected card value not being removed from the deck of cards;

providing one or more community cards;

determining whether the wager wins or loses;

wherein a wager on a selected card value wins if the selected card value may be used with the community cards to make a first winning hand, the first winning hand comprising at least one of one pair, two pair, three of a kind, flush, straight, full house, four of a kind, straight flush, and five of a kind;

wherein a wager on a wild card value wins if any card may be used to make a second winning hand, the second winning hand comprising at least one of three of a kind, flush, straight, full house, four of a kind, straight flush, and five of a kind;

wherein a wager on the first color wins if all of the community cards are the first color;

wherein a wager on the second color wins if all of the community cards are the second color; and wherein a wager on lo ball wins if all of the community cards are equal to or less than a first value.

2. The method of claim 1, wherein the deck of cards comprises one or more decks of standard playing cards less jokers.

3. The method of claim 1, wherein the first value is 8.

4. The method of claim 1, wherein four community cards are provided.

5. The method of claim 1, wherein a payout for a wager on a wild card value is 1 to 1 for three of a kind, 6 to 1 for a flush, 2 to 1 for a straight, 6 to 1 for a full house, 6 to 1 for a four of a kind, 30 to 1 for a straight flush, and 50 to 1 for a five of a kind.

6. The method of claim 1, wherein a payout for a wager on a selected card value is 1 to 1 for one pair, 2 to 1 for two pair, 3 to 1 for three of a kind, 7 to 1 for a flush, 15 to 1 for a straight, 20 to 1 for a full house, 50 to 1 for a four of a kind, 125 to 1 for a straight flush, and 250 to 1 for a five of a kind.

7. The method of claim 1, wherein a payout of a wager on lo ball is 6 to 1.

8. The method of claim 1, wherein a payout of a wager on a first color or a second color is 16to 1.

9. An apparatus for playing a card game, the apparatus comprising:

a computer system;

a video display terminal communicatively coupled to the computer system;

wherein the computer system is configured to perform the steps:

receiving an indication of a wager placed on one or more of a selected card value, a wild card value, a first color, a second color, and lo ball, each of the selected card value, the wild card value, the first color, the second color, and lo ball being offered;

causing one or more community cards from a deck of cards to be displayed on the video display terminal, wherein all cards corresponding to the selected card value remain in the deck of cards;

determining whether the wager wins or loses;

wherein a wager on a selected card value wins if the selected card value may be used with the community cards to make a first winning hand, the first winning hand comprising at least one of one pair, two pair, three of a kind, flush, straight, full house, four of a kind, straight flush, and five of a kind;

wherein a wager on a wild card value wins if any card may be used to make a second winning hand, the second winning hand comprising at least one of three of a kind, flush, straight, full house, four of a kind, straight flush, and five of a kind;

wherein a wager on the first color wins if all of the community cards are the first color;

wherein a wager on second color wins if all of the community cards are the second color; and wherein a wager on lo ball wins if all of the community cards are equal to or less than a first value.

10. The apparatus of claim 9, wherein the deck of cards comprises representations of one or more decks of standard playing cards less jokers.

11. The apparatus of claim 9, wherein the first value is 8.

12. The apparatus of claim 9, wherein four community cards are provided.

13. The apparatus of claim 9, wherein a payout for a wager on a wild card value is 1 to 1 for three of a kind, 6 to 1 for a flush, 2 to 1 for a straight, 6 to 1 for a full house, 6 to 1 for a four of a kind, 30 to 1 for a straight flush, and 50 to 1 for a five of a kind.

14. The apparatus of claim 9, wherein a payout for a wager on a selected card value is 1 to 1 for one pair, 2 to 1 for two pair, 3 to 1 for three of a kind, 7 to 1 for a flush, 15 to 1 for a straight, 20 to 1 for a full house, 50 to 1 for a four of a kind, 125 to 1 for a straight flush, and 250 to 1 for a five of a kind.

15. The apparatus of claim 9, wherein a payout of a wager on lo ball is 6 to 1.

16. The apparatus of claim 9, wherein a payout of a wager on a first color or a second color is 16 to 1.

17. A computer program product for playing a card game, the computer program product having a medium with a computer program embodied thereon, the computer program comprising:

computer program code for receiving an indication of a wager placed on one or more of a selected card value, a wild card value, a first color, a second color, and lo ball, each of the selected card value, the wild card value, the first color, the second color, and lo ball being offered;

computer program code for causing one or more community cards from a deck of cards to be displayed, wherein none of the cards corresponding to the selected card value are removed;

computer program code for determining whether the wager wins or loses;

wherein a wager on a selected card value wins if the selected card value may be used with the community cards to make a first winning hand, the first winning hand comprising at least one of one pair, two pair, three of a kind, flush, straight, full house, four of a kind, straight flush, and five of a kind;

wherein a wager on a wild card value wins if any card may be used to make a second winning hand, the second winning hand comprising at least one of three of a kind, flush, straight, full house, four of a kind, straight flush, and five of a kind;

wherein a wager on the first color wins if all of the community cards are the first color;

wherein a wager on second color wins if all of the community cards are the second color; and wherein a wager on lo ball wins if all of the community cards are equal to or less than a first value.

18. The computer program product of claim 17, wherein the deck of cards comprises representations of one or more decks of standard playing cards less jokers.

19. The computer program product of claim 17, wherein the first value is 8.

20. The computer program product of claim 17, wherein four community cards are provided.

21. The computer program product of claim 17, wherein a payout for a wager on a wild card value is 1 to 1 for three of a kind, 6 to 1 for a flush, 2 to 1 for a straight, 6 to 1 for a full house, 6 to 1 for a four of a kind, 30 to 1 for a straight flush, and 50 to 1 for a five of a kind.

22. The computer program product of claim 17, wherein a payout for a wager on a selected card value is 1 to 1 for one pair, 2 to 1 for two pair, 3 to 1 for three of a kind, 7 to 1 for a flush, 15 to 1 for a straight, 20 to 1 for a full house, 50 to 1 for a four of a kind, 125 to 1 for a straight flush, and 250 to 1 for a five of a kind.

23. The computer program product of claim 17, wherein a payout of a wager on lo ball is 6 to 1.

24. The computer program product of claim 17, wherein a payout of a wager on a first color or a second color is 16 to 1.

* * * * *